US011732851B2

(12) United States Patent
Liu et al.

(10) Patent No.: US 11,732,851 B2
(45) Date of Patent: Aug. 22, 2023

(54) DOWNLIGHT

(71) Applicants: SUZHOU OPPLE LIGHTING CO., LTD., Suzhou (CN); OPPLE LIGHTING CO., LTD., Shanghai (CN)

(72) Inventors: Zeyi Liu, Suzhou (CN); Yisheng Xiao, Suzhou (CN); Aiping Wang, Suzhou (CN)

(73) Assignees: Suzhou Opple Lighting Co., Ltd., Suzhou (CN); Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/562,998

(22) Filed: Dec. 27, 2021

(65) Prior Publication Data

US 2022/0120394 A1 Apr. 21, 2022

Related U.S. Application Data

(63) Continuation of application No. PCT/CN2020/122060, filed on Oct. 20, 2020.

(30) Foreign Application Priority Data

Nov. 8, 2019 (CN) ..... 201921939180.4

(51) Int. Cl.
*F21S 8/02* (2006.01)
*F21V 7/04* (2006.01)
*F21V 15/01* (2006.01)

(52) U.S. Cl.
CPC ..... *F21S 8/02* (2013.01); *F21V 7/04* (2013.01); *F21V 15/01* (2013.01)

(58) Field of Classification Search
CPC .... F21S 8/02; F21S 8/026; F21V 7/04; F21V 15/01; F21V 23/002; F21V 23/005; F21V 17/101
See application file for complete search history.

(56) References Cited

U.S. PATENT DOCUMENTS 10,677,444 B2 6/2020 Huang et al.
11,306,907 B2 * 4/2022 Gao ..... F21V 23/0442
(Continued)

FOREIGN PATENT DOCUMENTS

CN 203478157 U 3/2014
CN 204901421 U 12/2015
(Continued)

OTHER PUBLICATIONS

International Search Report of PCT Application No. PCT/CN2020/122060 dated Jan. 19, 2021 with English translation, (6p).

*Primary Examiner* — Tsion Tumebo
(74) *Attorney, Agent, or Firm* — Arch & Lake LLP

(57) ABSTRACT

A downlight, including a metal housing, an insulating reflective shell, a photoelectric module and a diffusion plate; the metal housing includes a base plate, a side wall, an assembly cavity, and a mounting opening, and a power port; the insulating reflective shell includes a mounting base plate, a reflective side wall, a light source cavity, and a light emission opening, a power port corresponding to the power port of the metal housing, and a ring of protrusion wall; the photoelectric module is provided in the light source cavity and is attached to the mounting base plate, the insulating reflective shell is fixed in the assembly cavity and the power port of the insulating reflective shell is aligned with the power port of the metal housing; and the diffusion plate is fixed to the metal housing and seals the mounting opening of the metal housing.

12 Claims, 5 Drawing Sheets

(56) References Cited

U.S. PATENT DOCUMENTS

| | | | | |
|---|---|---|---|---|
| 11,333,327 | B2 * | 5/2022 | Hu | F21V 3/0625 |
| 2009/0097262 | A1 * | 4/2009 | Zhang | F21V 29/713 362/364 |
| 2017/0261164 | A1 * | 9/2017 | Ogata | H05B 45/00 |
| 2018/0058676 | A1 * | 3/2018 | Huang | F21V 19/003 |
| 2019/0226671 | A1 * | 7/2019 | Huang | F21V 7/04 |
| 2019/0242552 | A1 * | 8/2019 | Liu | F21V 5/02 |

FOREIGN PATENT DOCUMENTS

| | | | |
|---|---|---|---|
| CN | 206600703 | U | 10/2017 |
| CN | 206875197 | U | 1/2018 |
| CN | 208011485 | U | 10/2018 |
| CN | 210717150 | U | 6/2020 |
| JP | 2007095393 | A | 4/2007 |
| JP | 2007095394 | A | 4/2007 |

* cited by examiner

DOWNLIGHT

CROSS-REFERENCE TO RELATED APPLICATIONS

This application is based upon and claims the priority of PCT patent application No. PCT/CN2020/122060 filed on Oct. 20, 2020 which claims priority to the Chinese patent application No. 201921939180.4 filed on Nov. 8, 2019, the entire contents of which are hereby incorporated by reference herein for all purposes.

TECHNICAL FIELD

The present disclosure relates to the technical field of lighting, and in particular to a downlight.

BACKGROUND

With the improvement in the living standard of people, lighting devices have become an indispensable electrical appliance in people's daily life and may provide lighting for the environment. To improve the lighting effect, a lens is commonly used for light distribution of a light-emitting unit in the current lighting device.

There are various types of lighting devices on the market, for example, chandeliers, ceiling lights, wall washing lights, etc. each having different characteristics. As a decorative light, a downlight can provide concentrated lighting for a local area, and has a good effect of enhancing an atmosphere.

SUMMARY

The present disclosure provides a downlight.

The present disclosure provides a downlight, including a metal housing, an insulating reflective shell, a photoelectric module and a diffusion plate. The metal housing includes a base plate, a side wall that surrounds the base plate, an assembly cavity jointly defined by the base plate and the side wall, and a mounting opening directly opposite to the base plate, and a power port is provided on the base plate of the metal housing; the insulating reflective shell includes a mounting base plate, a reflective side wall that surrounds the mounting base plate, a light source cavity jointly defined by the mounting base plate and the reflective side wall, and a light emission opening directly opposite to the mounting base plate, a power port corresponding to the power port of the metal housing is provided on the mounting base plate, and a ring of protrusion wall is provided around a side of the power port of the insulating reflective shell that faces toward the light emission opening; the photoelectric module is provided in the light source cavity and is attached to the mounting base plate, the insulating reflective shell is snap-fitted and fixed in the assembly cavity and the power port of the insulating reflective shell is aligned with the power port of the metal housing; and the diffusion plate is snap-fitted and fixed to the metal housing and seals the mounting opening of the metal housing.

It is to be understood that both the foregoing general description and the following detailed description are exemplary and explanatory only and are not restrictive of the present disclosure.

BRIEF DESCRIPTION OF THE DRAWINGS

The accompanying drawings illustrated herein serve to provide a further understanding of the present disclosure and constitute a part of the present disclosure. The examples and descriptions of the present disclosure are used to explain the present disclosure, and do not constitute an improper limitation of the present disclosure. In the drawings.

DETAILED DESCRIPTION

Figure 1:
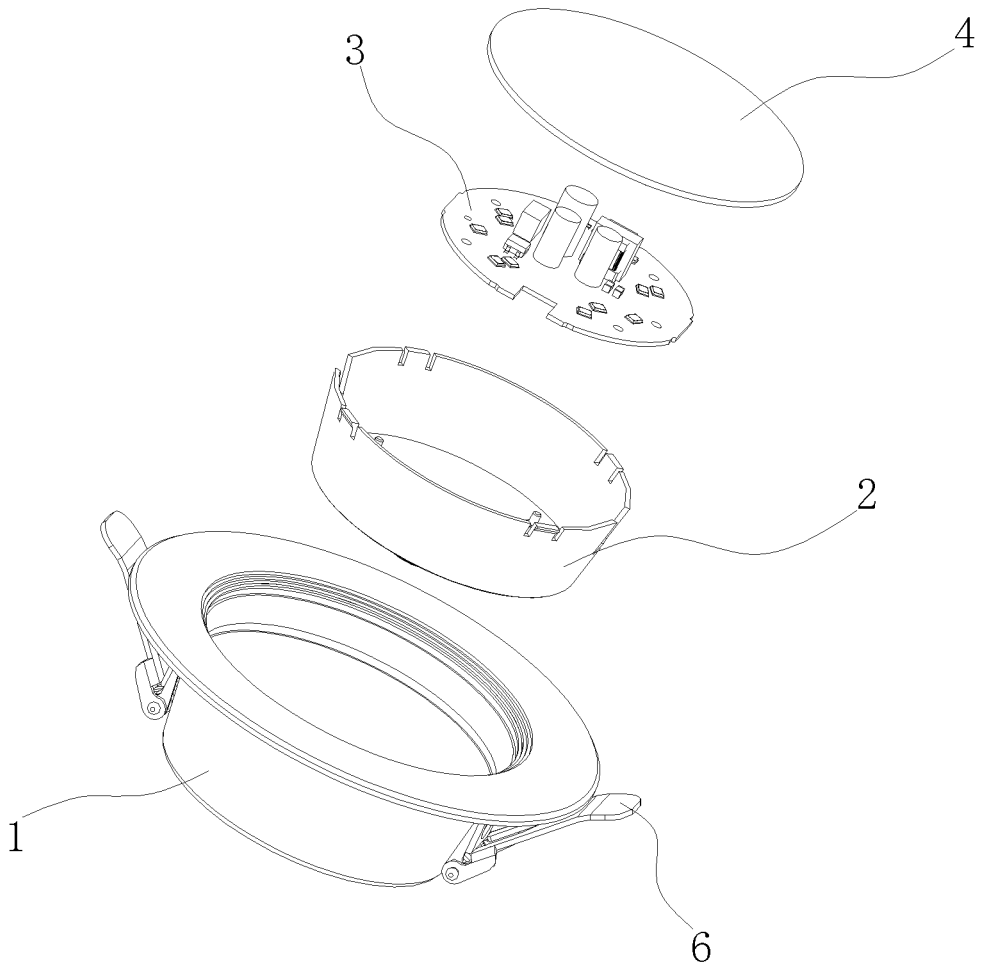
FIG. 1 is an exploded structural view of a downlight disclosed in one or more examples of the present disclosure.

Examples of the present disclosure will be described below in combination with the accompanying drawings of the present disclosure. Apparently, the described examples are merely a part rather than all the examples of the present disclosure. All other examples that are derived from the examples of the present disclosure by an ordinary skilled in the art without creative efforts shall fall within the protection scope of the present disclosure. The reference numerals in the accompanying drawings are merely used to distinguish different steps in technical solutions from each other, rather than delimiting execution orders of the steps. The specific execution order may be referred to the description in the present disclosure.

Terms used in the present disclosure are merely for describing specific examples and are not intended to limit the present disclosure. The singular forms "one", "the", and "this" used in the present disclosure and the appended claims are also intended to include a multiple form, unless other meanings are clearly represented in the context. It should also be understood that the term "and/or" used in the present disclosure refers to any or all of possible combinations including one or more associated listed items.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

It should be understood that although terms "first", "second", "third", and the like are used in the present disclosure to describe various information, the information is not limited to the terms. These terms are merely used to differentiate information of a same type. For example, without departing from the scope of the present disclosure, first information is also referred to as second information, and similarly the second information is also referred to as the first information. Depending on the context, for example, the term "if" used herein may be explained as "when" or "while", or "in response to . . . , it is determined that".

Explanations of Reference Numerals:

1-metal housing, 10-base plate of the metal housing, 100-power port of the metal housing, 11-side wall of the metal housing, 110-first snap-fit ring groove, 111-second snap-fit ring groove, 112-riveting hole, 12-assembly cavity, 13-mounting opening of the metal housing, 14-decorative flange, 2-insulating reflective shell, 20-mounting base plate, 200-power port of the insulating reflective shell, 201-protrusion wall, 202-thermally fusible post, 203-wire buckle, 203*a*-convex ridge for applying pressure, 204-gap for inserting a wedge, 21-reflective side wall of the insulating reflective shell, 210-snap-fit piece/buckle of the insulating reflective shell; 211-avoidance notch, 22-light source cavity, 23-light emission opening, 3-photoelectric module, 30-substrate, 300-through hole for inserting the thermally fusible post, 31-light source, 32-driver element, 4-diffusion plate, 5-wedge, 6-hanger spring, 9-power wire, 90-insulating cover layer, 91-conductive lead.

To improve an aesthetic appearance, the downlight in the related art generally uses a metal housing, and in order to reduce costs, structures of various parts of the downlight are generally designed to be easily assembled with each other. However, the simpler the assembly manner is, the lower the safety of the downlight is, the more likely the metal housing is charged. Therefore, how to simplify the assembly manner of the downlight while avoiding charging the metal housing of the downlight is a technical problem to be solved urgently in the art.

Figure 2:
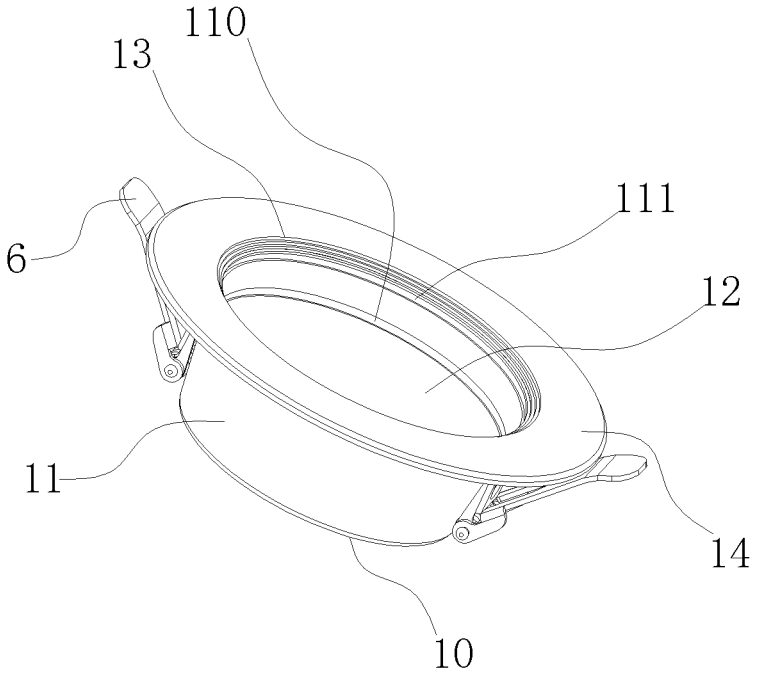
FIG. 2 is a detailed structural view of a metal housing and a hanger spring disclosed in one or more examples of the present disclosure.
Figure 3:
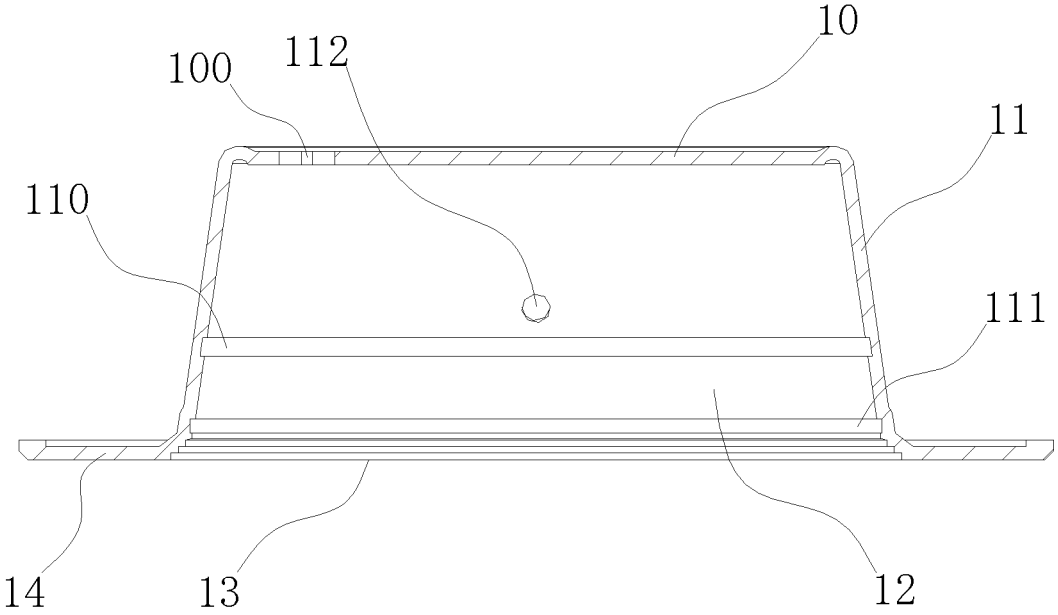
FIG. 3 is a cross-sectional structural view of the metal housing disclosed in one or more examples of the present disclosure.

The examples of the present disclosure disclose a downlight, as shown in FIG. 1 to FIG. 7, the downlight comprises a metal housing 1, an insulating reflective shell 2, a photoelectric module 3 and a diffusion plate 4. Here, the metal housing 1 is a main body and a protective structure of the downlight. As shown in FIG. 2 and FIG. 3, the metal housing 1 comprises a base plate 10, a side wall 11 that surrounds the base plate 10, an assembly cavity 12 jointly defined by the base plate 10 and the side wall 11, and a mounting opening 13 directly opposite to the base plate 10. In addition, the metal housing 1 for example further comprises a decorative flange 14 that surrounds the mounting opening 13. A power port 100 of the metal housing 1 is provided on the base plate 10 of the metal housing 1 and is used for an external power wire 9 to enter into the assembly cavity 12.

Figure 4:
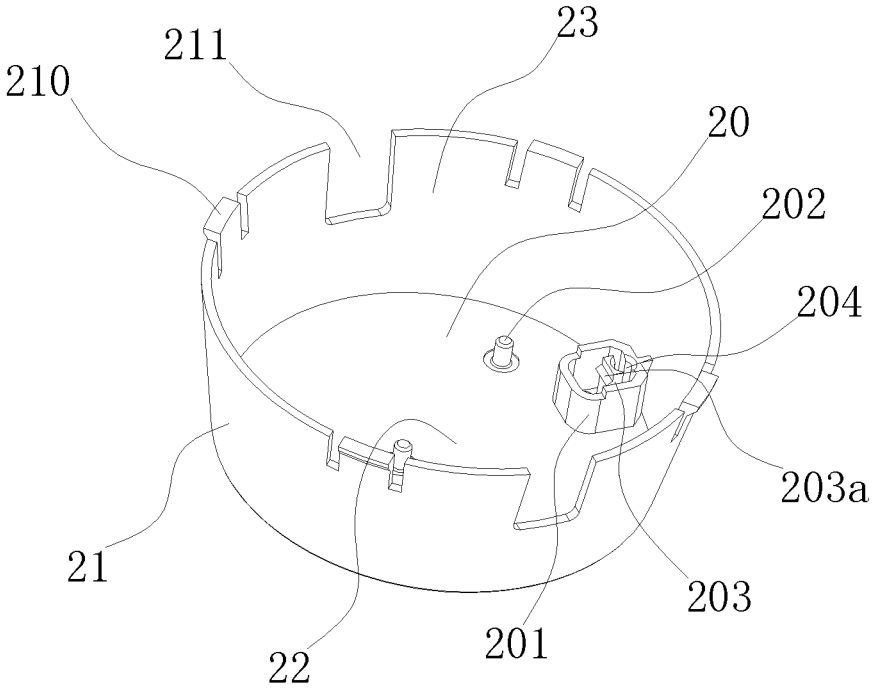
FIG. 4 is a detailed structural view of an insulating reflective shell disclosed in one or more examples of the present disclosure.

The insulating reflective shell 2 in the examples of the present disclosure for example is made of a material that has a high reflectivity, for example, PC (polycarbonate), or the like. As shown in FIG. 4, the insulating reflective shell 2 for example comprises a mounting base plate 20, a reflective side wall 21 that surrounds the mounting base plate 20, a light source cavity 22 jointly defined by the mounting base plate 20 and the reflective side wall 21, and a light emission opening 23 directly opposite to the mounting base plate 20. In addition, a power port 200 of the insulating reflective shell 2, which corresponds to the power port 100 of the metal housing 1, is provided on the mounting base plate 20; the power port 200 of the insulating reflective shell 2 is also used for the power wire 9 to pass through; and a ring of protrusion wall 201 is further provided around a side of the power port 200 of the insulating reflective shell 2 that faces toward the light emission opening 23.

Figure 5:
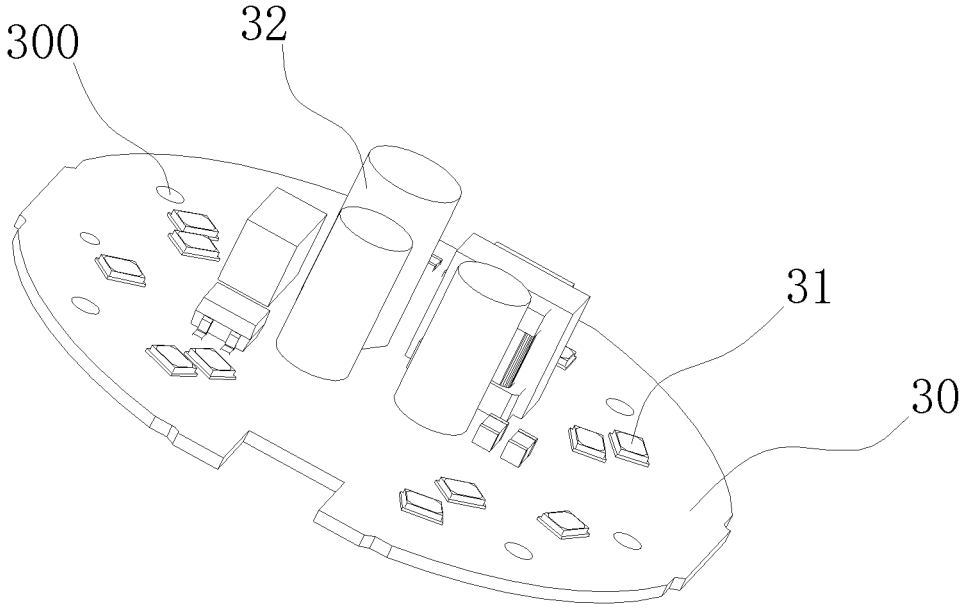
FIG. 5 is a detailed structural view of a photoelectric module disclosed in one or more examples of the present disclosure.

The photoelectric module 3 is provided in the light source cavity 22 and is attached to the mounting base plate 20, and as shown in FIG. 5, the photoelectric module 3 in the examples of the present disclosure for example comprises a substrate 30, a light source 31 and a plurality of driver elements 32; the light source 31 and the plurality of driver elements 32 are provided on the substrate 30. Here, in consideration of uniform light emission, the light source 31 for example is provided around the driver elements 32. The photoelectric module 3 and the insulating reflective shell 2 in the examples of present disclosure may be fixedly connected with each other in various manners, for example, snap-fit, adhesion, or the like are all taken into consideration. As shown in FIG. 4, the examples of the present disclosure provide a relatively simple fixing manner as an example, in which a thermally fusible post 202 is provided on the mounting base plate 20, and a through hole 300 for inserting the thermally fusible post 202 is provided on the substrate 30. During assembly, the substrate 30 is attached to the mounting base plate 20, an end part of the thermally fusible post 202 passes through the through hole 300, and then the end part of the thermally fusible post 202 is thermally fused to form a thick riveting end to fix the substrate 30, thereby fixing the substrate 30 to the mounting base plate 20. After the substrate 30 is fixed, the light source 31 emits light toward the light emission opening 23.

After the photoelectric module 3 is fixedly connected to the insulating reflective shell 2, the insulating reflective shell 2 and the photoelectric module 3 are placed into the mounting cavity 12 together, and are fixed to the metal housing 1 by using the insulating reflective shell 2. There are also various manner for fixing the insulating reflective shell 2 to the metal housing 1. In consideration of manufacturing costs of the metal housing 1, the metal housing 1 in the examples of the disclosure for example is formed by punching, and therefore, a snap-fit structure on the metal housing 1 also needs to be simplified as much as possible so as to facilitate subsequent formation of the snap-fit structure.

As shown in FIG. 2 and FIG. 3, in the examples of present disclosure, a first snap-fit ring groove 110 is provided on the side wall 11 of the metal housing 1, and the snap-fit ring groove 110 for example is directly formed on the punching-formed side wall 11 of the metal housing 1 by a lathe, such that the snap-fit ring groove 110 is simple and the formation thereof is easy. At the same time, as shown in FIG. 4, a snap-fit piece 210 is provided on the side wall 21 of the insulating reflective shell 2, and the insulating reflective shell 2 and the metal housing 1 are snap-fitted and fixed to each other by the snap-fit piece 210 of the insulating reflective shell 2 and the first snap-fit ring groove 110. Because an insulating polymer material is used for forming the insulating reflective shell 2 and the formation of the insulating reflective shell 2 is easy, it is convenient to form the snap-fit piece 210 with a relatively complex structure, and the snap-fit deformation is achieved by using the good elasticity of the polymer material to improve the snap-fit effect. For example, in the examples of the present disclosure, a plurality of snap-fit pieces 210 in a buckle pattern are circumferentially provided on the side of the reflective side wall 21 of the insulating reflective shell 2 adjacent to the light emission opening 23.

Upon fixing the insulating reflective shell 2 into the assembly cavity 12, the power port 100 of the metal housing 1 is aligned with the power port 200 of the insulating reflective shell 2; then, the power wire 9 successively passes through the power port 100 of the metal housing 1 and the power port 200 of the insulating reflective shell 2 until it extends over the protrusion wall 201, and then the power wire 9 is bent back so as to be electrically connected to the substrate 30 of the photoelectric module 3. Due to the existence of the protrusion wall 201, the power line 9 needs to extend across the protrusion wall 201 so as to be possible to pass through the power port 200 of the insulating reflective shell 2; compared with a conventional arrangement manner, such a structure has relatively high safety and can effectively prevent the metal housing 1 from being charged.

Figure 6:
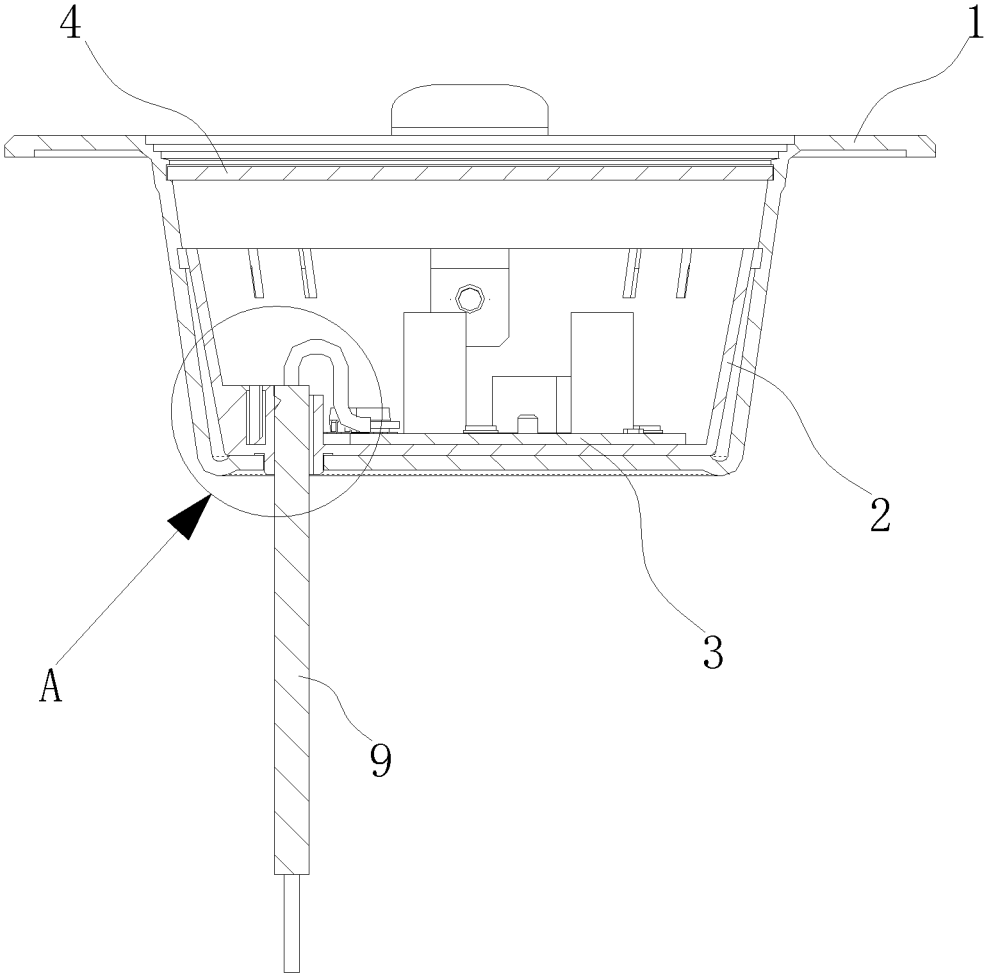
FIG. 6 is an overall cross-sectional structural view of the downlight disclosed in one or more examples of the present disclosure.
Figure 7:
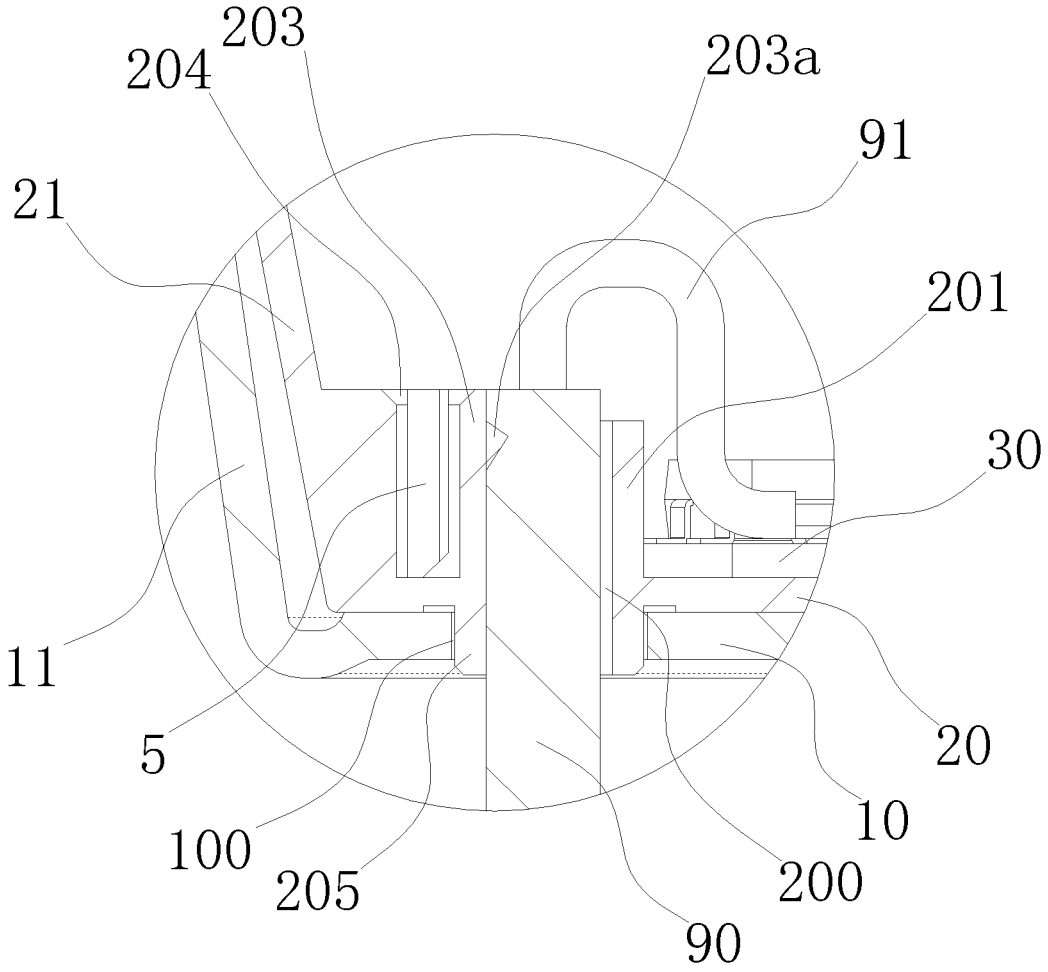
FIG. 7 is a partially enlarged structural view of a region A in FIG. 6.

As shown in FIG. 6 and FIG. 7, the power wire 9 in the examples of the present disclosure comprises an insulating cover layer 90 and a conductive lead 91 wrapped by the insulating cover layer 90. To ensure the good insulating performance, the insulating cover layer 90 for example passes through the power port 100 of the metal housing 1 and the power port 200 of the insulating reflective shell 2 and then is flush with the protrusion wall 201 or extends over the protrusion wall 201. Then, the conductive lead 91 individually extends from the end part of the insulating cover layer 90 and is bent toward and electrically connected to the photoelectric module 3.

To fix the power wire 9, as shown in FIG. 4, FIG. 6 and FIG. 7, the examples of the present disclosure provide a wire buckle 203 on the mounting base plate 20, and the wire buckle 203 is provided in a region surrounded by the protrusion wall 201 and is provided at the side of the power port 200 of the insulating reflective shell 2 that faces toward the light emission opening 23. The wire buckle 203 and the protrusion wall 201 together clamp the insulating cover layer 90. Further, in order to prevent the power wire 9 from freely moving in the length direction thereof to be separated from the photoelectric module 3, a convex ridge for applying pressure 203*a* is further provided on a side of the wire buckle 203 that faces an axis of the power port 200 of the insulating reflective shell 2, and a gap 204 for inserting a wedge for example is provided between the protrusion wall 201 and a side of the wire buckle 203 that faces away from the power port 200 of the insulating reflective shell 2. A wedge 5 is provided in the downlight; in the case that the power wire 9 is provided between the wire buckle 203 and the protrusion wall 201, the wedge 5 is inserted into the gap 204, and the wedge 5 extrudes and pushes the wire buckle 203 to deform, such that the convex ridge for applying pressure 203*a* and the protrusion wall 201 tightly clamp the insulating cover layer 90. At this time, the convex ridge for applying pressure 203*a* extrudes the insulating cover layer 90 to obviously deform, thereby preventing the insulating cover layer 90 to move in the length direction thereof. The wedge 5 in the examples of the present disclosure may be of a general wedge-shaped structure, but in consideration of avoiding that the wedge is separated from the gap 204 for inserting the wedge, a screw for example is used as the wedge 5; a thread for example is provided inside the gap 204 for inserting the wedge, and a head part of the screw is used to extrude the wire buckle 203.

Further, in the examples of present disclosure, a ring of insulating enclosure wall 205 is provided around a side of the power port 200 of the insulating reflective shell 2 that faces away from the light emission opening 23; in the case that the insulating reflective shell 2 is assembled into the assembly cavity 12, the insulating enclosure wall 205 passes through the power port 100 of the metal housing 1. In this way, an insulating protection layer is formed between the power wire 9 and the metal housing 1 by means of the insulating enclosure wall 205, such that the insulating effect is better.

For the metal housing 1 formed by punching, it is impossible to make the structure of the base plate 10 of the metal housing 1 too complex, for example, in the examples of the present disclosure, the base plate 10 of the metal housing 1 is substantially a plane, and it is difficult to provide some heat dissipation structures and the like on the base plate 10. Therefore, to ensure the thermal safety of the downlight provided by the examples of the disclosure and prevent local overheating, the substrate 30 in the examples of the disclosure for example is an aluminum substrate, and the mounting base plate 20 is attached to the base plate 10 of the metal housing 1. The aluminum substrate differs from a common PCB substrate in that the aluminum substrate has a metal aluminum layer. Due to the poor thermal conductivity of an insulating base material of the PCB, the heat is concentrated nearby the electrical components, cannot be rapidly spread laterally, and only is dissipated by means of longitudinal heat dissipation. Because the aluminum substrate has a metal aluminum layer, the heat from the light source 31 and the driver elements 32 are quickly and laterally dissipated by means of the metal aluminum layer, such that the heat of the whole metal aluminum layer becomes uniform, and therefore, the requirements on the longitudinal heat dissipation is reduced. The heat dissipation requirement is satisfied by means of a heat conduction manner of attaching the mounting base plate 20 to the base plate 10 of the metal housing 1, such that manufacturing cost of the metal housing 1 can be effectively reduced while avoiding local overheating.

In the examples of the disclosure, after the insulating reflective shell 2 and the photoelectric module 3 are mounted into the assembly cavity 12, the diffusion plate 4 is snap-fitted and fixed to the metal housing 1 and seals the mounting opening 13 of the metal housing 1. Similar to the fixing manner of the insulating reflective shell 2, a second snap-fit ring groove 111 is provided on the side wall 11 of the metal housing 1, and the second snap-fit ring groove 111 is provided at a position adjacent to the mounting opening 13 of the metal housing 1, and then an edge of the diffusion plate 4 is directly snap-fitted and fixed to the second snap-fit ring groove 111.

For the downlight, a mounting component such as a hanger spring 6 for example is provided; in the examples of the disclosure, a riveting hole 112 is provided on the side wall 11 of the metal housing 1, and the hanger spring 6 is riveted and fixed to the metal housing 1 by means of the riveting hole 112. In order to prevent the reflective side wall 21 of the insulating reflective shell 2 from blocking the riveting hole 112 or interfering with a riveting structure, an avoidance notch 211 is provided on the reflective side wall of the insulating reflective shell 2 to correspond to the riveting hole 112.

The present disclosure provides a downlight, comprising a metal housing, an insulating reflective shell, a photoelectric module and a diffusion plate. The metal housing comprises a base plate, a side wall that surrounds the base plate, an assembly cavity jointly defined by the base plate and the side wall, and a mounting opening directly opposite to the base plate, and a power port is provided on the base plate of the metal housing; the insulating reflective shell comprises a mounting base plate, a reflective side wall that surrounds the mounting base plate, a light source cavity jointly defined by the mounting base plate and the reflective side wall, and a light emission opening directly opposite to the mounting base plate, a power port corresponding to the power port of the metal housing is provided on the mounting base plate, and a ring of protrusion wall is provided around a side of the power port of the insulating reflective shell that faces toward the light emission opening; the photoelectric module is provided in the light source cavity and is attached to the mounting base plate, the insulating reflective shell is snap-fitted and fixed in the assembly cavity and the power port of the insulating reflective shell is aligned with the power port of the metal housing; and the diffusion plate is snap-fitted and fixed to the metal housing and seals the mounting opening of the metal housing.

Optionally, in the downlight as described above, a wire buckle is provided on the mounting base plate, the wire buckle is provided in a region surrounded by the protrusion wall and is provided on a side of the power port of the insulating reflective shell, and the wire buckle and the protrusion wall are configured to clamp a power wire.

Optionally, in the downlight as described above, a convex ridge for applying pressure is provided on a side of the wire buckle that faces toward an axis of the power port of the insulating reflective shell, a gap for inserting a wedge is provided between the protrusion wall and a side of the wire buckle that faces away from the power port of the insulating reflective shell, the downlight further comprises a wedge, and the wedge is inserted into the gap for inserting the wedge to push the convex ridge for applying pressure to clamp the power wire.

Optionally, in the downlight as described above, the photoelectric module comprises a substrate, a light source and a driver element, both the light source and the driver element are provided on the substrate and face toward the light emission opening.

Optionally, in the downlight as described above, the substrate is an aluminum substrate, and the mounting base plate of the insulating reflective shell is attached to the base plate of the metal housing.

Optionally, in the downlight as described above, a thermally fusible post is provided on the mounting base plate, a through hole for inserting the thermally fusible post is provided on the substrate, and an end part of the thermally fusible post passes through the through hole for inserting the thermally fusible post and is thermally fused to form a riveting end.

Optionally, in the downlight as described above, a first snap-fit ring groove is provided on the side wall of the metal housing, a snap-fit piece of the insulating reflective shell is provided on the reflective side wall of the insulating reflective shell, and the insulating reflective shell and the metal housing are snap-fitted and fixed to each other by the first snap-fit ring groove and the snap-fit piece of the insulating reflective shell.

Optionally, in the downlight as described above, a plurality of snap-fit pieces of the insulating reflective shell are circumferentially provided on a side of the side wall of the insulating reflective shell adjacent to the light emission opening.

Optionally, in the downlight as described above, a second snap-fit ring groove is provided on the side wall of the metal housing, and the diffusion plate is snap-fitted and fixed to the second snap-fit ring groove.

Optionally, the downlight as described above further comprises a hanger spring, a riveting hole is provided on the side wall of the metal housing, and the hanger spring is riveted and fixed to the metal housing by the riveting hole.

Optionally, in the downlight as described above, an avoidance notch corresponding to the riveting hole is provided on the reflective side wall of the insulating reflective shell.

Optionally, in the downlight as described above, a ring of insulating enclosure wall is provided around a side of the power port of the insulating reflective shell that faces away from the light emission opening, and the insulating enclosure wall passes through the power port of the metal housing.

To summarize, the downlight provided by the examples of the present disclosure effectively increases the creepage difficulty and thus effectively reduces the risk of charging the metal housing.

The above examples of the present disclosure focus on the differences between the various examples, all different optimization features among the various examples may be combined to form better examples as long as they do not conflict with each other, and for the sake of simplicity, the descriptions thereof will not be repeated here.

The foregoing is only the examples of the present disclosure and is not intended to limit the present disclosure. It will be apparent to those skilled in the art that various modifications and variations can be made in the present disclosure. Any modification, equivalent substitution, improvement, etc. within the spirit and principle of the present disclosure should be included in the scope of claims of the present disclosure.

The invention claimed is:

1. A downlight, comprising a metal housing, an insulating reflective shell, a photoelectric module and a diffusion plate, wherein the metal housing comprises a base plate, a side wall that surrounds the base plate, an assembly cavity jointly defined by the base plate and the side wall, and a mounting opening directly opposite to the base plate, and a power port is provided on the base plate of the metal housing;

the insulating reflective shell comprises a mounting base plate, a reflective side wall that surrounds the mounting base plate, a light source cavity jointly defined by the mounting base plate and the reflective side wall, and a light emission opening directly opposite to the mounting base plate, a power port corresponding to the power port of the metal housing is provided on the mounting base plate, and a ring of protrusion wall is provided around a side of the power port of the insulating reflective shell that faces toward the light emission opening;

the photoelectric module is provided in the light source cavity and is attached to the mounting base plate, the insulating reflective shell is snap-fitted and fixed in the assembly cavity and the power port of the insulating reflective shell is aligned with the power port of the metal housing; and the diffusion plate is snap-fitted and fixed to the metal housing and seals the mounting opening of the metal housing, wherein a wire buckle is provided on the mounting base plate, the wire buckle is provided in a region surrounded by the protrusion wall and is provided on a side of the power port of the insulating reflective shell that faces toward the light emission opening, a gap is provided between the protrusion wall and a side of the wire buckle that faces away from the power port of the insulating reflective shell, a wedge is inserted into the gap and the wedge extrudes and pushes the wire buckle to deform such that a convex ridge and the protrusion wall clam an insulating cover layer of a power wire, and one side of the wedge is flush with one side of the insulating cover layer of the power wire.

2. The downlight of claim 1, wherein one side of the gap is flush with the one side of the insulating cover layer.

3. The downlight of claim 2, wherein the convex ridge for applying pressure is provided on a side of the wire buckle that faces toward an axis of the power port of the insulating reflective shell, and the wedge is inserted into the gap for inserting the wedge to push the convex ridge for applying pressure to clamp the power wire.

4. The downlight of claim 1, wherein the photoelectric module comprises a substrate, a light source and a driver element, both the light source and the driver element are provided on the substrate and face toward the light emission opening.

5. The downlight of claim 4, wherein the substrate is an aluminum substrate, and the mounting base plate of the insulating reflective shell is attached to the base plate of the metal housing.

6. The downlight of claim 4, wherein a thermally fusible post is provided on the mounting base plate, a through hole for inserting the thermally fusible post is provided on the substrate, and an end part of the thermally fusible post passes through the through hole for inserting the thermally fusible post and is thermally fused to form a riveting end.

7. The downlight of claim 1, wherein a first snap-fit ring groove is provided on the side wall of the metal housing, a snap-fit piece of the insulating reflective shell is provided on the reflective side wall of the insulating reflective shell, and the insulating reflective shell and the metal housing are snap-fitted and fixed to each other by the first snap-fit ring groove and the snap-fit piece of the insulating reflective shell.

8. The downlight of claim 7, wherein a plurality of snap-fit pieces of the insulating reflective shell are circumferentially provided on a side of the side wall of the insulating reflective shell adjacent to the light emission opening.

9. The downlight of claim 1, wherein a second snap-fit ring groove is provided on the side wall of the metal housing, and the diffusion plate is snap-fitted and fixed to the second snap-fit ring groove.

10. The downlight of claim 1, further comprising a hanger spring, wherein a riveting hole is provided on the side wall of the metal housing, and the hanger spring is riveted and fixed to the metal housing by the riveting hole.

11. The downlight of claim 10, wherein an avoidance notch corresponding to the riveting hole is provided on the reflective side wall of the insulating reflective shell.

12. The downlight of claim 1, wherein a ring of insulating enclosure wall is provided around a side of the power port of the insulating reflective shell that faces away from the light emission opening, and the insulating enclosure wall passes through the power port of the metal housing.

* * * * *